United States Patent [19]

Sprecher

[11] 4,189,112

[45] Feb. 19, 1980

[54] FORMATION OF BALLS OF KNITTING YARN

[75] Inventor: Andreas Sprecher, Neu Brunn, Switzerland

[73] Assignee: G & W Maschinen AG, Switzerland

[21] Appl. No.: 898,158

[22] Filed: Apr. 20, 1978

[51] Int. Cl.[2] ..... B65H 55/00; B65H 55/04

[52] U.S. Cl. ..... 242/159; 28/290; 206/410; 242/2; 242/53; 242/172; 242/174

[58] Field of Search ..... 242/159, 174, 2, 47, 242/18 R, 53, 172; 206/410; 28/289, 290, 291

[56] References Cited

U.S. PATENT DOCUMENTS

| | | | |
|---|---|---|---|
| 4,089,479 | 5/1978 | Lucke | 242/2 |

FOREIGN PATENT DOCUMENTS

| | | | |
|---|---|---|---|
| 291272 | 4/1916 | Fed. Rep. of Germany | 242/165 |
| 361351 | 10/1922 | Fed. Rep. of Germany | 242/2 |
| 2130224 | 9/1972 | Fed. Rep. of Germany | 242/2 |
| 546699 | 3/1974 | Switzerland | 242/47 |
| 1396468 | 6/1975 | United Kingdom | 242/47 |

*Primary Examiner*—Stanley N. Gilreath

[57] ABSTRACT

A ball of hand knitting yarn is formed by winding the yarn in an overlapping constantly progressing angular winding to form a partial sphere, thereafter continuing the winding by applying a plurality of turns of said yarn in substantially parallel circumferential turns about substantially a central equator of the ball and subsequently finishing the winding with a plurality of overlapping progressively angled windings so as to hide the circumferential turns.

7 Claims, 6 Drawing Figures

FORMATION OF BALLS OF KNITTING YARN

BACKGROUND OF THE INVENTION

The present invention relates to the formation of packages of hand knitting yarn and in particular to balls thereof.

It has long been the practice to package yarn for hand knitting in hanks or skeins which then had to be unpackaged by the user and rewound in balls, so that the yarn could easily be handled without knitting or ravelling. Recently, automatic machines have been developed by which balls have been directly wound and banded into packages, in which the yarn has been wound in a pattern which can easily be unthreaded and directly used by the knitter.

One such machine for fully automatic balling and banding of yarn is distributed in the United States by the G & W Maschinen AG, CH 8330 Pfaffikon, Zurich, Switzerland, under Model No. WBAN 204/305 and 205/305.

In this machine the balls are formed on a rotating, expansible arbor, by feeding the yarn on a thread flyer or guide arm which arm makes a complexedly curved swinging movement simultaneously about the arbor. The combination of rotation of the arbor and the movement of the guide cooperate to wind the yarn in an overlapping constant angular progression, substantially like a figure eight pattern. On completing the winding of a predetermined amount of yarn a substantially spherical ball is formed, after which the arbor is collapsed and the ball doffed or removed from the arbor. Thereafter a printed band is placed about the ball to complete the package. Because the ball is wound on the expanded arbor only, its doffing results in a collapse and distortion of the ball which causes difficulty in applying the banding.

It is the object of the present invention to overcome this difficulty and provide a method for winding the ball which prevents distortion of the ball when doffed, facilitates the application of the band, and produces an improved package of balled yarn.

SUMMARY OF THE INVENTION

According to the present invention, yarn is balled by winding the same about an expanded arbor by movement of the guide arm in the generally known manner. Prior to completion of the ball winding the guide arm is controlled so that a plurality of radial turns of the yarn are wrapped about the partially completed ball substantially along a diameter in a plane perpendicular to the axis of the arbor. Thereafter the completion of the ball winding is effected.

Preferably, the number of radial turns is held small and provides no more than one or two layers, and is thereafter covered by a plurality of layers wound in the figure eight pattern so that it is inconspicuous and not visible from the exterior.

BRIEF DESRIPTION OF THE DRAWINGS

DESCRIPTION OF THE INVENTION

Figure 4:
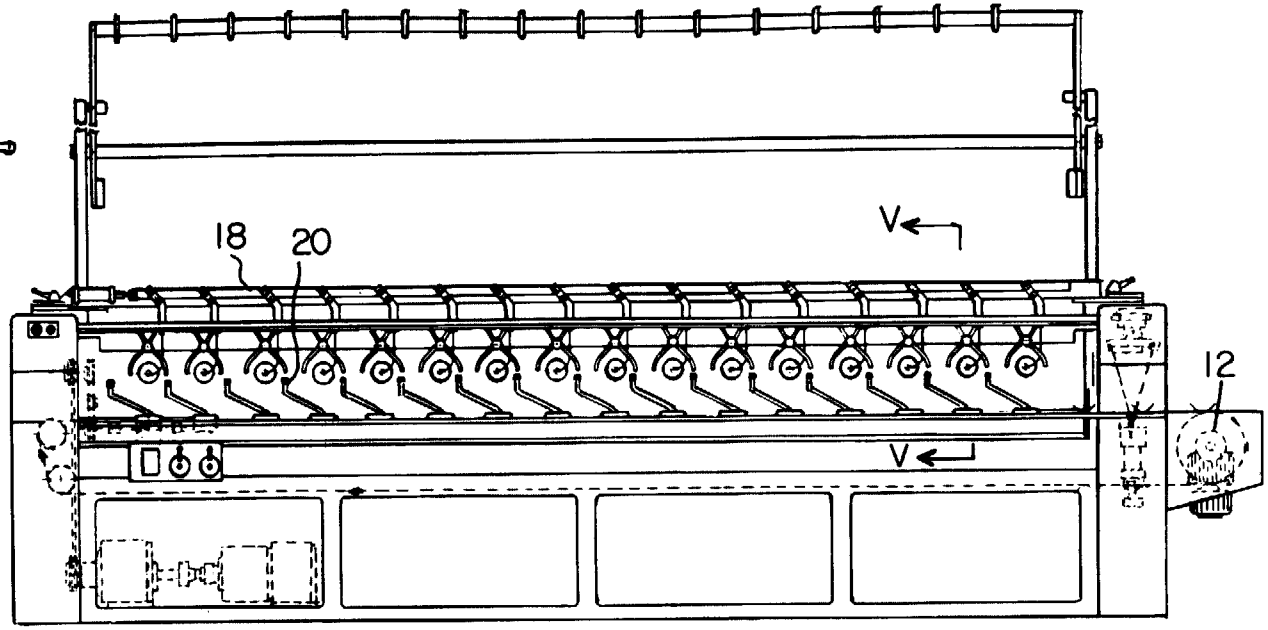
FIG. 4 is a front view of a portion of the ball winding machine, illustrating the apparatus for carrying out the present invention.
Figure 6:
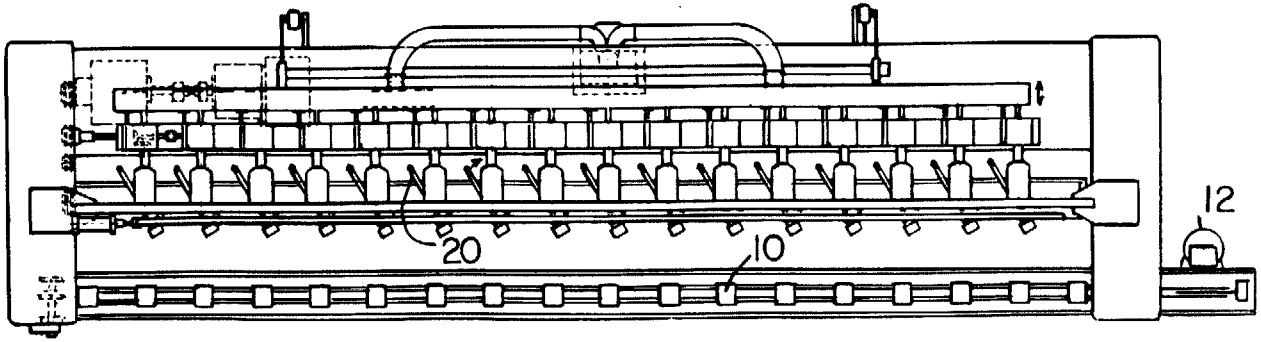
FIG. 6 is a top plan view of the machine shown in FIG. 4.
Figure 5:
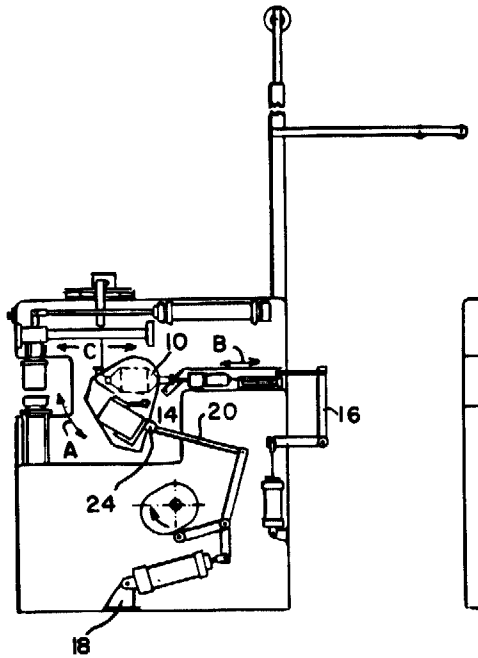
FIG. 5 is a sectional view taken along lines V—V of FIG. 4

Turning first to the method of carrying out the present invention, reference is made to FIGS. 4 through 6 which illustrate the aforementioned G & W Maschinen apparatus. The machine basically comprises a plurality of arbors 10 mounted on the machine frame for rotation about its central axis. The arbor is connected directly or indirectly by means of a belt or other transmission to a drive motor 12 and comprises a plurality of parallel members mounted about a central shaft 14, by link means 16 which allow the members to expand and collapse, as required, relative to the central shaft 16.

Mounted in front of the arbors is an elongated bracket 18 on which are mounted a plurality (corresponding in number to the arbors) of yarn flyer mechanisms generally depicted by the numeral 20. The flyers 20 are pivotally mounted to the frame of the machine and are movable by a hydraulic motor and/or suitable cam and articulated linkage so that it pivots in an arcuate path transverse to the shaft 16 indicated by the arrow A. The flyer mechanism 20 comprises a spring loaded arm having a yarn guide 24 at its outer end. The arm extends beneath the bracket and is movable perpendicular to the bracket 18 along a path B substantially parallel to the surface of the arbor.

It will be observed that the movement along the path A when combined with the movement of the yarn guide 24 along path B, moves the yarn guide both axially and circumferential (at least in part) relative to the arbor in a complex path which causes the yarn to overlap in a constant progressive angle along the length of the arbor. When coupled with the rotation of the arm, the yarn itself is resultantly applied to the arbor, in a substantially wound ball of substantially spherical shape.

Mounted to the rear of the arbor is a pusher member, which when actuated moves in a path C causing the finished ball to be doffed from the arbor. Not shown are the creel and feed means for the yarn, cutting means, end tucking means, etc., all of which are found in the aforementioned commercial machine. In addition to the foregoing elements, the commercial machine includes control means for rotating the arbor, and yarn flyers as well as pivoting the flyer support bracket, in a predefined and selectable rate.

Once the yarn is doffed, it falls on a conveyor on which it is moved to a banding machine included with or separately from the aforementioned commercial machine.

For further details of the machine reference can be made to the commercial machines, which are well known to those skilled in the art, currently available from G & W Maschine.

Figure 1:
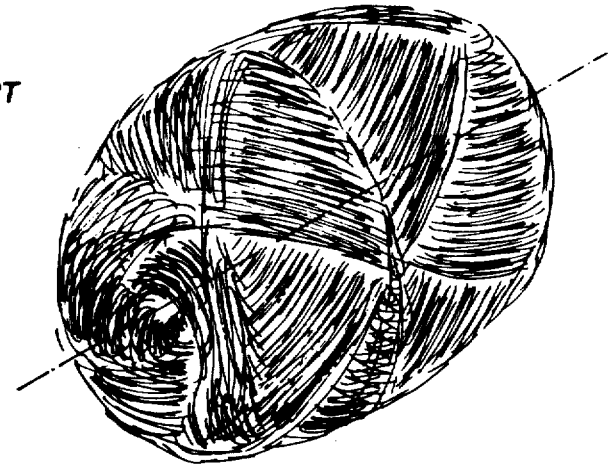
FIG. 1 PRIOR ART
FIG. 1 is a perspective view of a ball wound in accordance with the prior art, without the band applied.

It has been known heretofore, to wind the yarn continuously in overlapping constant angular progression, by rotating the arbor and by pivoting the bracket and flyer in a continuous uninterrupted relationship so that the entire ball is formed in the same figure eight or similarly wound pattern, producing a ball such as shown in FIG. 1. It will be observed that this ball is substantially loose, having an ill defined spherical shape. It is difficult to place a band about such a ball and to maintain integrity of the wind and stability for shipping and handling.

Figure 3:
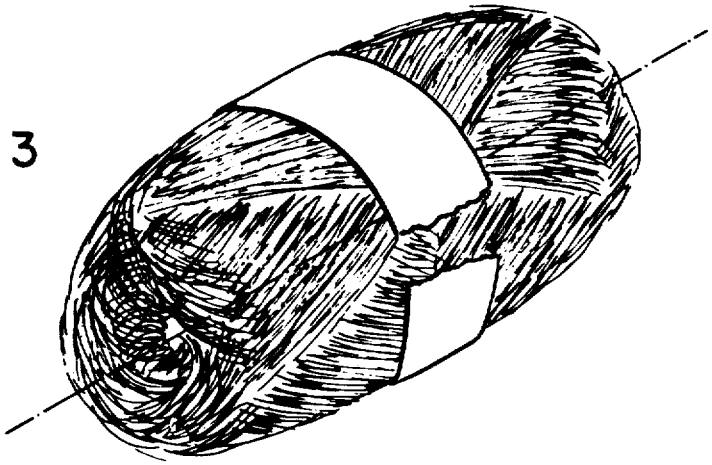
FIG. 3 is a view of a wound ball in accordance with the present invention showing the radial turns and illustrating the position of the band.
Figure 2:
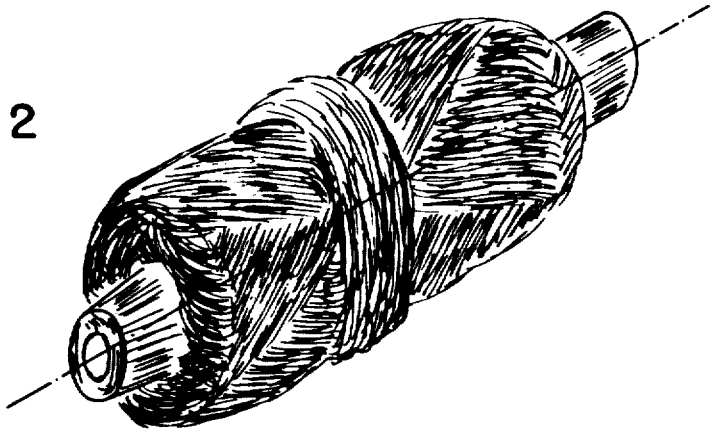
FIG. 2 is a view of a view of a ball partially wound in accordance with the present invention.

In accordance with the present invention, the ball is initially wound on the machine illustrated in conventional manner, until at least one half of the ball size is wound as seen in FIG. 2. At this point, the movement of the flyer 20 is controlled so that it is pivoted to place the tip of the flyer substantially midway between the ends of the arbor. At this point the flyer 20 is held so that the yarn is applied circumferentially about the arbor. This is accomplished by holding the flyer arm stationary and interrupting its movement along path B for a time sufficient to permit the arbor to rotate several times while permitting the flyer 20 to pivot. This results in depositing a band or layer of radially disposed yarns about the central equator of the ball, as seen in FIG. 3.

The flyer 20 may be reciprocated one or two times within a very narrow range about the equator to wind more than one layer, if desired; however, it is not necessary to wind more than two or three radial layers. The reciprocation of the bracket should be held in a narrow range so that perhaps no more than 5 to 10 windings or turns are formed in each layer, thus limiting the band of radial turns.

After the radial turns are formed, the machine is returned to its normal operation and the progressive angular winding is completed, overlying and hiding the radial windings. Thus the ball wound in accordance with the present invention provides an inner body portion of progressively angled windings, an intermediate radial winding portion and an outer body portion similar to the first portion.

After the completed ball is formed, it is doffed from arbor, as seen in FIG. 2 which is an enlarged distortion. The ball when doffed has its spherical shape modified somewhat to assume a peanut shape wherein its central portion, or equator is moderately constricted presumably by the tension of the radial turns. This stabilizes the ball, and permits the band to be more accurately and securely applied about it. The band is either self sealing, heat sealed or with wet glue applied in coventional manner about the equator.

The radial turns are made after at least 50% of the ball is completed and preferably between 50–70%. In this manner, the true shape is distorted only slightly and after the band is applied, the natural resiliency of the ball causes the ball to take a more truly spherical shape. In addition, the remaining 30–50% of the winding not only covers the radial portion, hiding it from view, but also reinforces the "ball like" appearance of the ball when doffed.

The radial windings or turns can be effected by interrupting the motor or transmission means moving the flyer arm, and limiting the reciprocation of the bracket 18 or by slowing its movement perceptably while increasing the speed of the arbor. Since the winding machines are basically mechanically operated through the use of control cams and drive means, with a minimum of electrical and/or electronic control systems, the inclusion of suitable additional or replacement cams, timing devices, relay motor controls and similar control means can be easily effected and will be known to those skilled in this art.

While the present invention has been described with reference to the aforementioned G & W Maschinen Type 204 and 205/305 balling and banding machines, it will be appreciated that its teachings can be employed on other machines and processes. It is therefore intended that the present disclosure be taken as illustrative only and not as limiting of the present invention.

What is claimed is:

1. The method of forming a spherical ball of a predetermined length of knitting yarn comprising the steps of continuously (a) winding the yarn for a predetermined period in an overlapping constantly progressing angular winding to form a partially completed sphere, (b) thereafter winding a plurality of turns of said yarn in substantially parallel circumferential turns about substantially a central equator of the partially completed sphere and (c) subsequently finishing the winding with a plurality of overlapping progressively angled windings so as to hide the circumferential turns and complete the sphere.

2. The method according to claim 1 including the step of carrying out at least 50% of the winding in step (a).

3. The method according to claims 1 or 2 including the step of applying a band about the exterior circumference of the ball, after performing step (c), said band being located substantially about the circumferential turns.

4. The method according to claims 1 or 2, wherein step (a) includes winding the yarn about a rotating arbor, feeding said yarn to said arbor by a reciprocating flyer to generate in cooperation therewith a traverse of said yarn along said arbor and arresting the movement of the yarn relative to the arbor after forming a partially completed sphere to form the plurality of circumferential turns.

5. A ball of knitted yarn comprising a first portion formed of a plurality of overlapping constant angular progressing windings forming an inner body, a second portion formed of a plurality of substantially parallel turns wound circumferential about said body substantially along an equator thereof and a third portion formed by a plurality of overlapping constant angular progressing windings overlying said first and second portions.

6. The ball according to claim 5 wherein said first portion constitutes at least 50% of said finished product.

7. The ball according to claims 5 or 6 including a band applied about the circumference of said finished product substantially along the equator about which the second portion is wound.

* * * * *